US006378233B1

(12) United States Patent
Haines-Woon

(10) Patent No.: US 6,378,233 B1
(45) Date of Patent: Apr. 30, 2002

(54) PHOTO POSTCARD DISPLAY

(76) Inventor: Enid E. Haines-Woon, P.O. Box 26552, Tamarac, FL (US) 33320

( * ) Notice: Subject to any disclaimer, the term of this patent is extended or adjusted under 35 U.S.C. 154(b) by 0 days.

(21) Appl. No.: 09/644,897

(22) Filed: Aug. 24, 2000

Related U.S. Application Data

(60) Provisional application No. 60/175,690, filed on Jan. 12, 2000.

(51) Int. Cl.[7] ..... A47G 1/06; A47G 1/08

(52) U.S. Cl. ..... 40/788; 40/786

(58) Field of Search ..... 40/786, 788, 789, 40/539; 206/449; 428/14, 124; 229/75

(56) References Cited

U.S. PATENT DOCUMENTS 2,181,827 A * 11/1939 Ziemmerman ..... 40/787
3,295,674 A * 1/1967 Shore ..... 40/788
4,008,852 A 2/1977 Davis ..... 229/92.3
5,275,863 A * 1/1994 Hanson ..... 428/124
5,359,794 A 11/1994 Wood ..... 40/155
D386,008 S 11/1997 Wong ..... D6/310
5,950,341 A 9/1999 Cross ..... 40/750

* cited by examiner

*Primary Examiner*—Cassandra H. Davis
(74) *Attorney, Agent, or Firm*—Richard C. Litman

(57) ABSTRACT

A multi-functional display with an adjustable aperture to accommodate pictures, photographs, or artwork of different sizes. The display can be used as a postcard or as a stationary frame for displaying pictures in an upright position. The display is made from a blank of flexible material such as paper.

5 Claims, 7 Drawing Sheets

PHOTO POSTCARD DISPLAY

CROSS-REFERENCE TO RELATED APPLICATION

This application claims the benefit of U.S. Provisional Patent Application Ser. No. 60/175,690, filed Jan. 12, 2000.

BACKGROUND OF THE INVENTION

1. Field of the Invention

The present invention relates generally to displays and more particularly, to a multi-size, adhesive-backed paper display for displaying photographs, postcards, and small artwork. The paper display of the present invention can be used as a postcard.

2. Description of Related Art

Finding an appropriate means to display cherished photographs or artwork can be a daunting task. Even finding a suitable means for displaying a vacation photo can be difficult because a frame of the appropriate size must be found, and even then there is no way to send the framed photo to someone without enclosing the photo and frame in a package and mailing the entire package, which can be expensive. It would be extremely advantageous to have a picture or artwork frame that was so versatile that it could readily be used as either a postcard or a stationary frame.

The prior art describes a variety of display means for displaying photographs and the like, for example, an ornamental design for a photo display frame made from paper is described in U.S. Pat. No. Des. 3,86,008, issued on Nov. 11, 1997 to M. S. Wong. U.S. Pat. No. 4,008,852, issued on Feb. 22, 1977 to E. O. Davis, describes an apertured mailing card. The mailing card consists of first and second card sections. The first card section contains an adhesive surface for carrying an object such as a photograph. The second card section is attached to the first card section and includes an opening situated for general alignment with the adhesive surface of the first card section when the first and second sections are in a folded condition.

A picture frame derived from a sheet blank is described in U.S. Pat. No. 5,359,794, issued on Nov. 1, 1994 to H. W. Wood. The picture frame is configured to provide straight peripheral frame sections which are closed at the corners and may project at less than a 90 degree angle from a base to produce an attractive beveled border. U.S. Pat. No. 5,950, 341, issued on Sep. 14, 1999 to J. A. Cross, describes a display device and easel. The frame is fabricated from a single piece of paperboard divided into three foldable panels which are die-cut according to a predetermined pattern to create a display opening and easels for supporting the frame in a horizontal or vertical orientation.

None of the above inventions and patents, taken either singly or in combination, is seen to describe the instant invention as claimed.

SUMMARY OF THE INVENTION

Accordingly, it is a principal object of the invention to provide a display means that is extremely versatile in its functionality.

It is another object of the invention to provide a display means that has an adjustable aperture to accommodate different size photographs.

It is a further object of the invention to provide a display means of novel configuration made from a blank of flexible sheet material.

Still another object of the invention is to provide a display means that is low cost and economical to manufacture.

It is an object of the invention to provide improved elements and arrangements thereof in a display means for the purposes described which is inexpensive, dependable and fully effective in accomplishing its intended purposes.

To meet the above objectives, the present invention provides a conformable photo postcard display. The configurable display means of the present invention is made using a novel and innovative folding sequence that produces a display means with a unique and distinctive configuration. The photo postcard display is formed from a blank of flexible sheet material such as paper and configured to function as either a postcard or a stationary frame. The photo postcard display has an adjustable aperture to accommodate photographs of different sizes.

The visual display means of the present invention is efficiently designed with strategically placed adhesive material ensuring its structural integrity. The photo postcard display has a stand for exhibiting the photo postcard display in an upright position.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
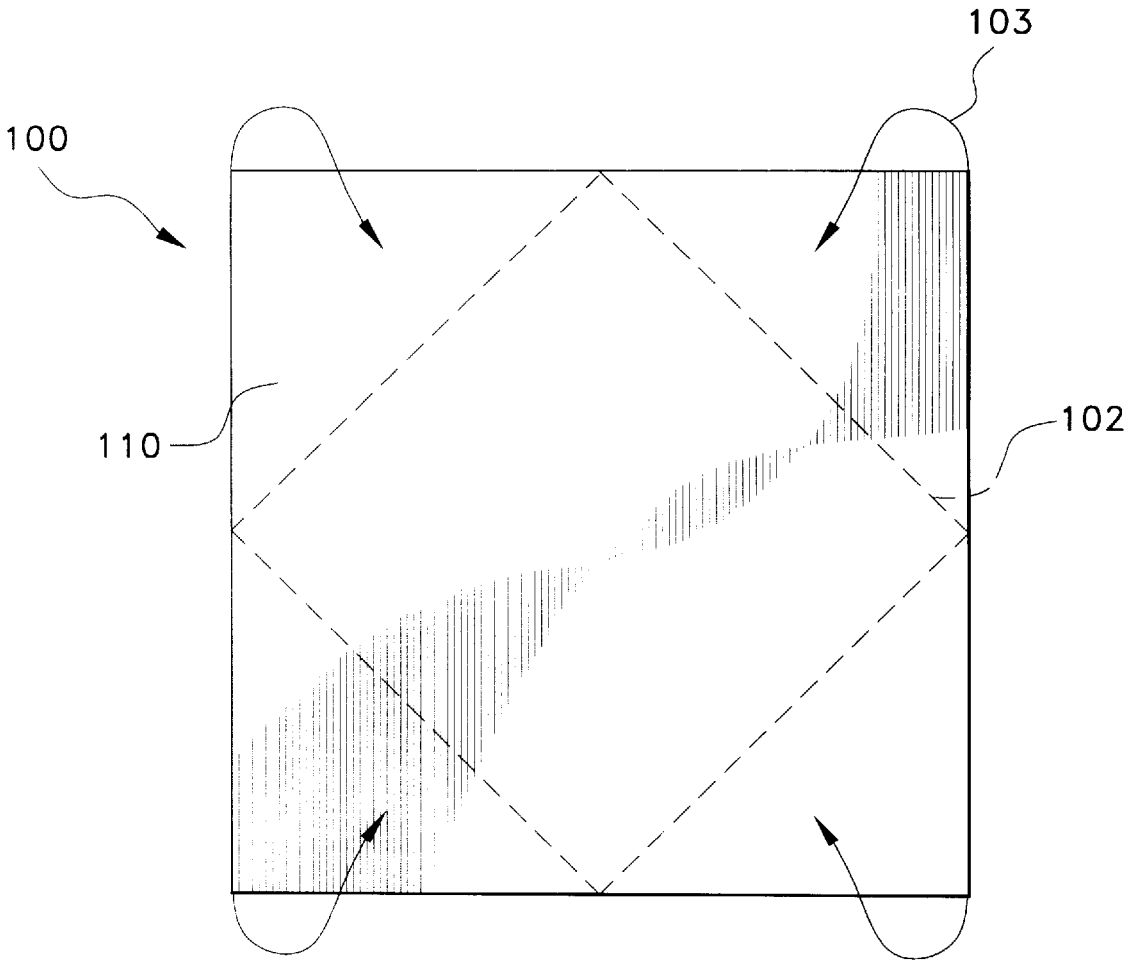
FIG. 1A is a front plan view of an unfolded sheet of paper that is eventually folded into a photo postcard display showing the initial fold lines according to the present invention.

The present invention, as depicted in FIGS. 1A–D,2, 3A–B, and 4 is a conformable photo postcard display 100 with a size adjustable centrally disposed viewing aperture 160,162. FIG. 1A is a front view of an unfolded square shaped blank of flexible sheet material 100 such as paper that is eventually folded into a photo postcard display 100. The initial fold lines 102 are shown in FIG. 1A. Each corner 109 of the sheet of paper 100 is folded towards the center 115 of the sheet of paper 100 as indicated by the directional arrows 103. This folding action produces a smaller square structure 125 defined by the initial fold lines 102. The centrally disposed photograph receiving aperture 160,162 readily displays 3"×5" or 4"×6" pictures or pieces of artwork because the aperture 160,162 is scalable. The conformable display 100 can be made of any suitable flexible sheet material.

Figure 1B:
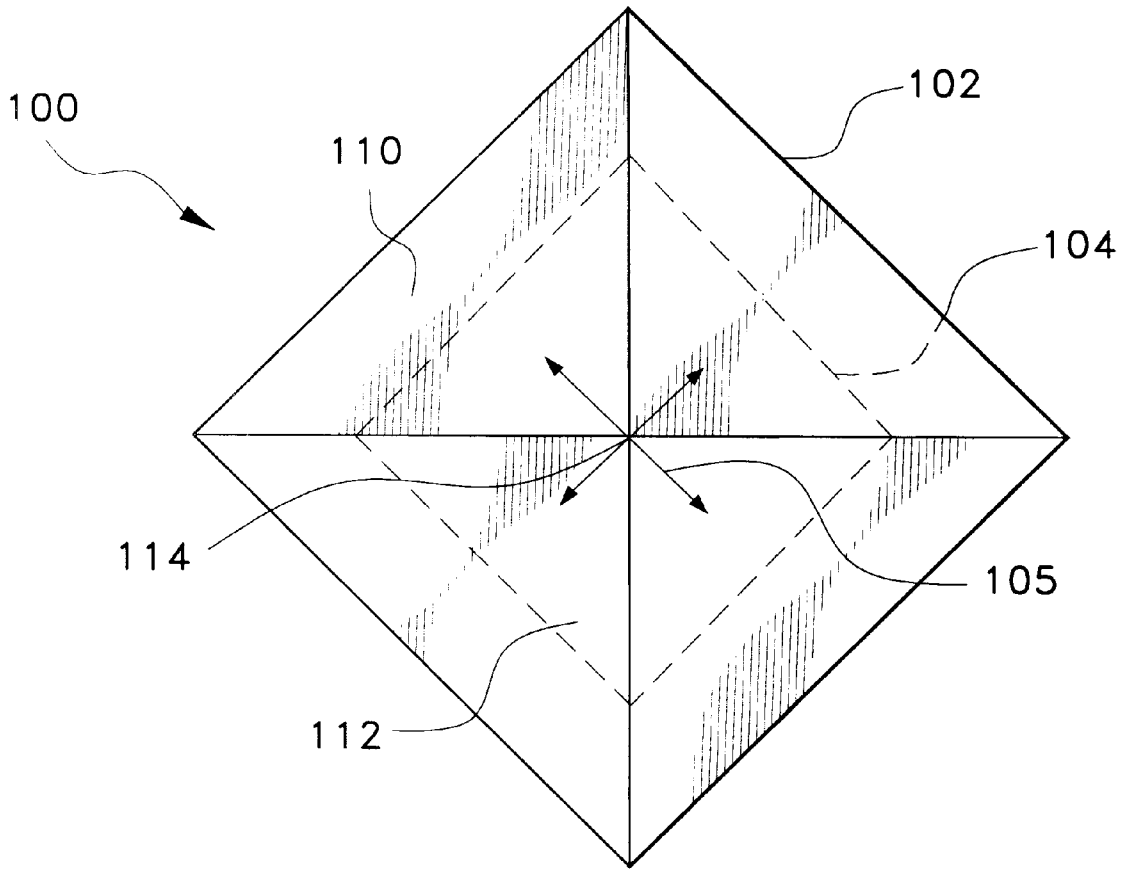
FIG. 1B is a front plan view of a folded sheet of paper that has been folded along the initial fold lines showing the second fold lines and the directions of the next folding action.
Figure 1C:
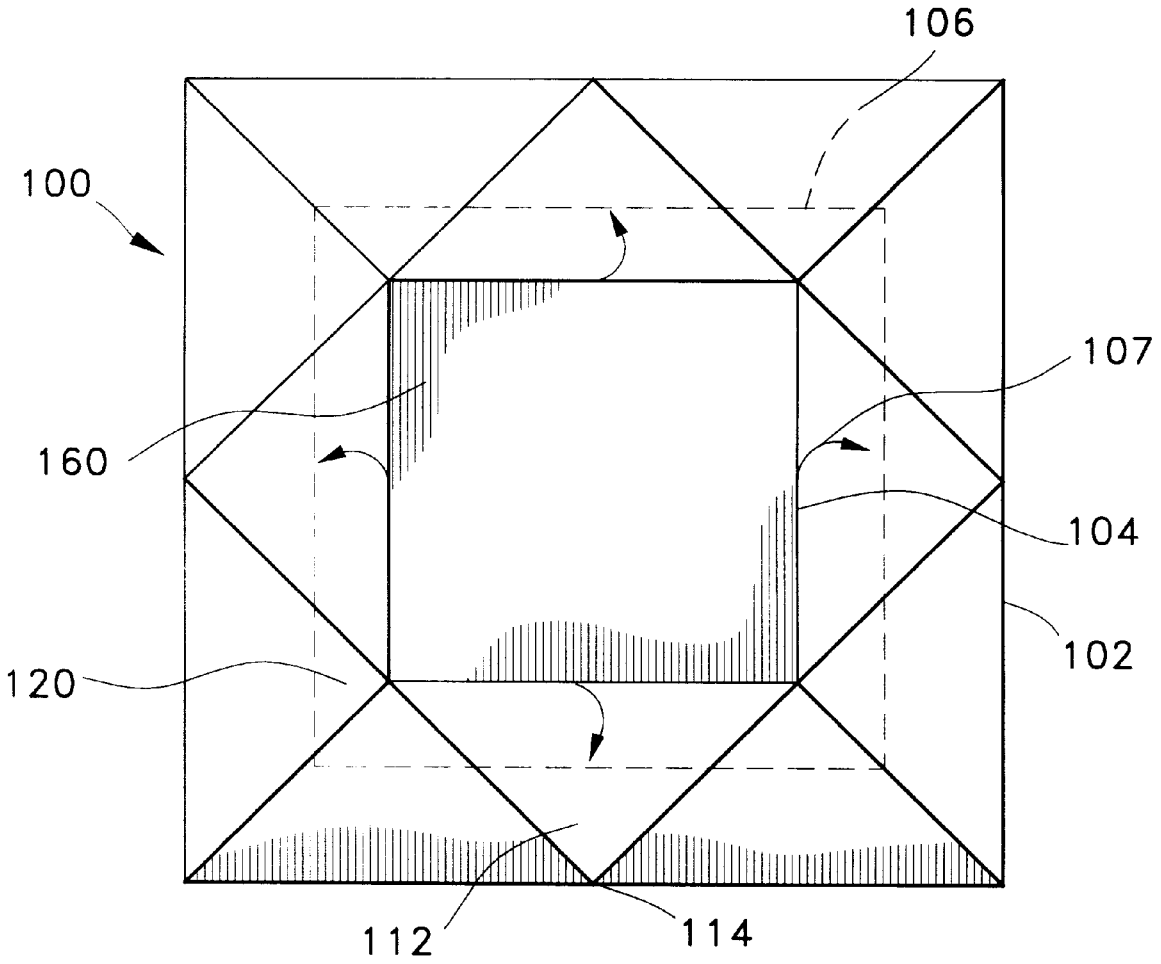
FIG. 1C is a front plan view of a folded sheet of paper that has been folded along the second fold lines showing the third fold lines and the direction of the ensuing folding action.

FIG. 1B is a front view of the folded sheet of paper 100 that has been folded along the initial fold lines 102 showing the location of the second fold lines 104 and the direction 105 of the next folding action. The apex 114 of each triangular shaped section 110 is folded back in the direction 105 indicated until the apex 114 of each triangular shaped section 110 reaches the midpoint 135 of each edge or side 102 as depicted In FIG. 1C. The edges or sides 102 of the smaller square folded structure 100 shown in FIG. 1B are defined by the initial folding lines 102 shown in FIG. 1A. The second folding lines 104 shown in FIG. 1B define a first smaller aperture 160 shown in FIG. 1C. The aperture 160 shown in FIG. 1C can readily accommodate a picture, photograph, or artwork having 3 inch×5 inch dimensions.

Figure 1D:
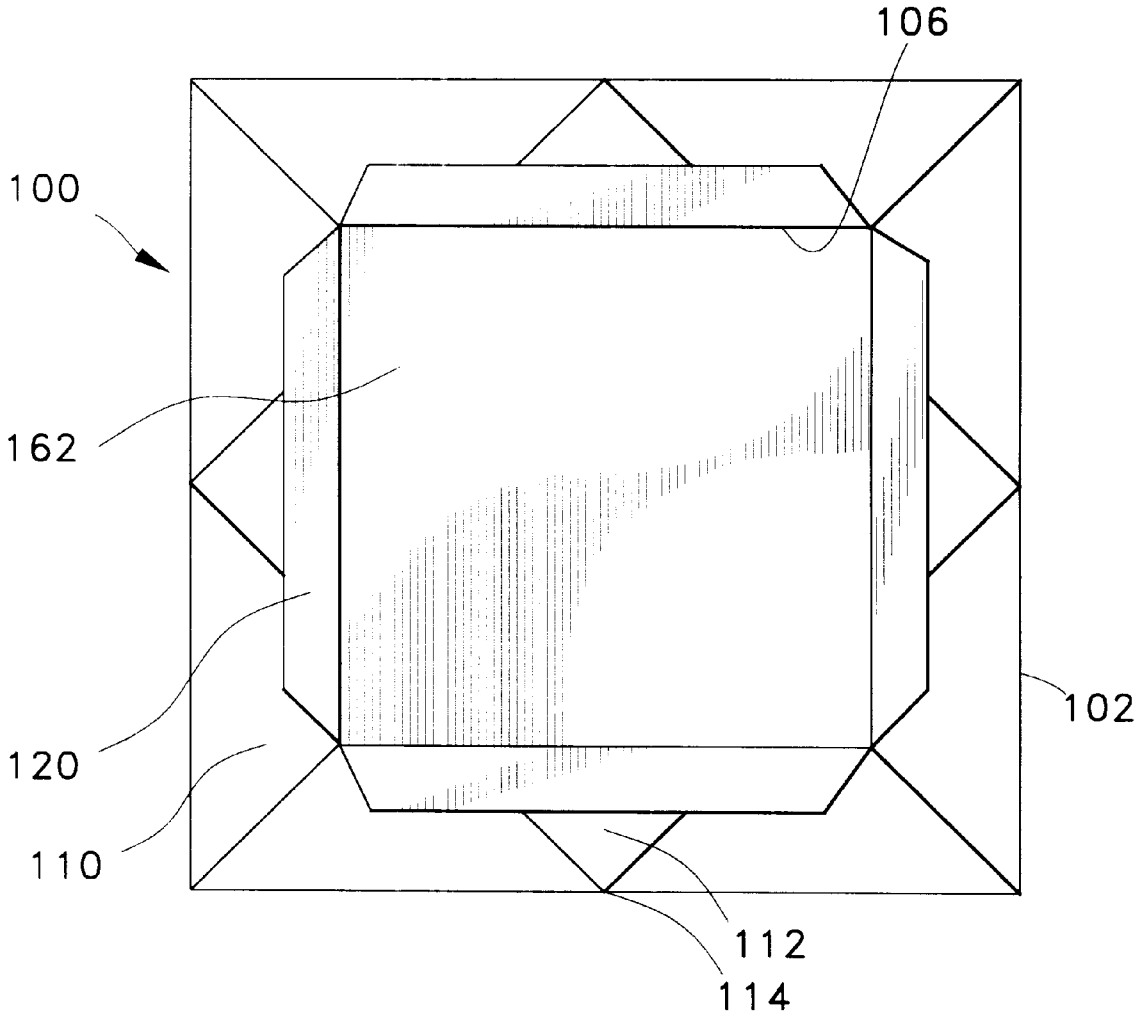
FIG. 1D is a front plan view of a folded sheet of paper that has been folded along the third fold lines showing the conformation of a large apertured photo postcard display.

FIG. 1C is a front view of a folded sheet of paper 100 that has been folded along the second fold lines 104 showing the location of the third fold lines 106 and the direction 107 of the ensuing folding action. The third folding lines 106 define a second larger aperture 162 as shown in FIG. 1D. FIG. 1D is a front view of a folded sheet of paper 100 that has been folded along the third fold lines 106 showing the conformation of a large aperture photo postcard display 100. The aperture 162 shown in FIG. 1D can readily accommodate a picture, photograph, or artwork having 4 inch×6 inch dimensions. The trapezoidal shaped folded section 120 produced by the third folding action gives the photo postcard display 100 a distinctive and decorative appearance as depicted in FIG. 1D. This distinctive and decorative appearance consists of a symmetrical arrangement of movable folds 112,120.

Figure 2:
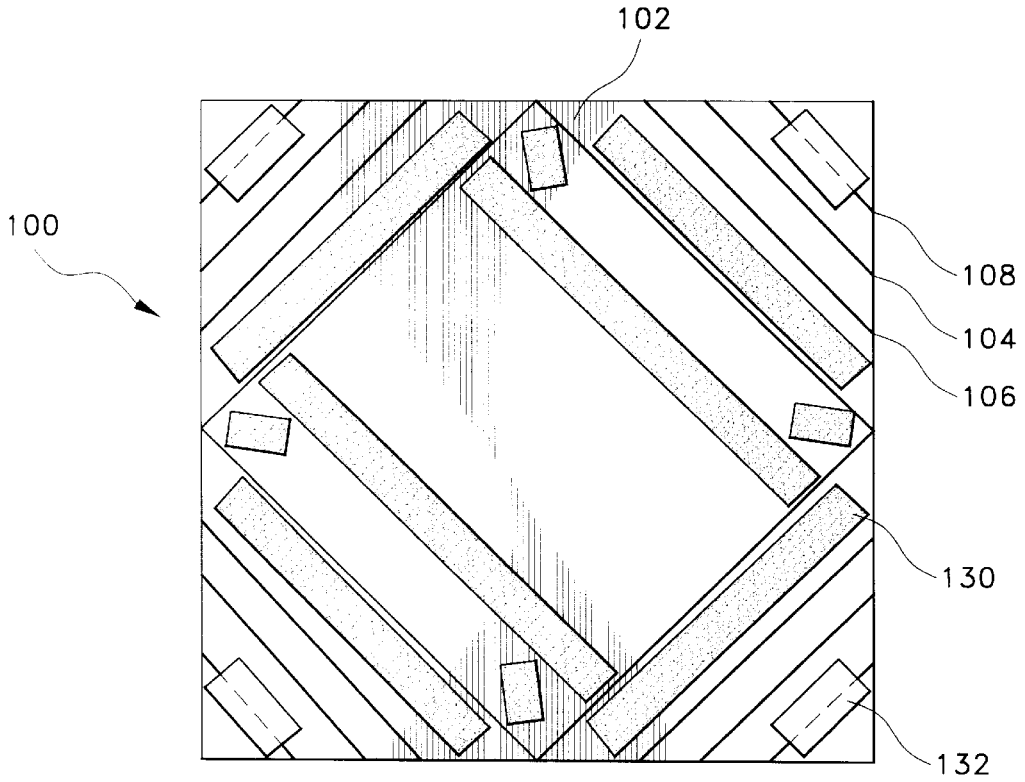
FIG. 2 is a front plan view of an unfolded sheet of paper that is eventually folded into a photo postcard display showing the locations of adhesive tapes and fold lines.

FIG. 2 is a front view of an unfolded sheet of paper 100 that is eventually folded into a photo postcard display 100 showing the locations of adhesive material 130,132 and fold lines 102,104,106. The third folding action along the third fold lines 106 produces an additional crease 108 as shown in FIG. 2 because the third folding action involves folding a folded segment 117 (see FIG. 1C). This skeleton or framework of adhesive material 130,132 such as adhesive tape maintains the structural integrity of the photo postcard display 100.

Figure 3A:
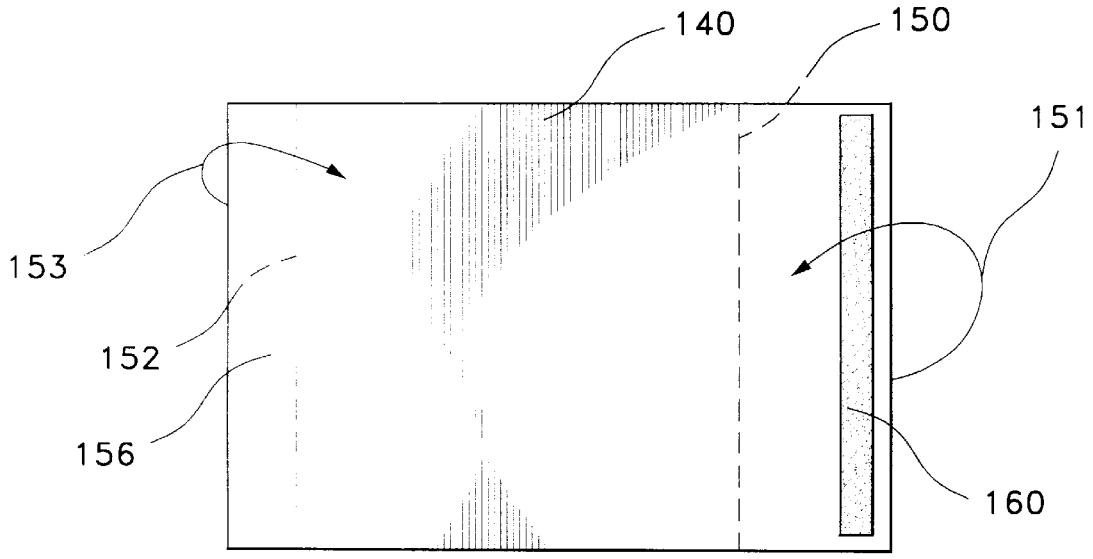
FIG. 3A is a front plan view of the unfolded sheet of paper that is eventually folded into a stand for a photo postcard display showing the fold lines and the bottom adhesive tape's location.

FIG. 3A is a front view of an unfolded sheet of paper 138 that is eventually folded into a stand 140 for a photo postcard display 100 showing the fold lines 150,152, the directions 151, 153 of the folding actions, and the bottom adhesive tape's location 160. The first folding action along the first fold line 150 in the direction 151 indicated shortens the length of the stand 140, and subsequently stabilizes the stand 140. The second folding action along the second fold line 152 in the direction 153 indicated also shortens the length of the stand 140. The stand 140 can be made of any flexible sheet material. The conformable display 100 and the stand 140 can be made of the same flexible sheet material or made of different flexible sheet materials.

Figure 3B:
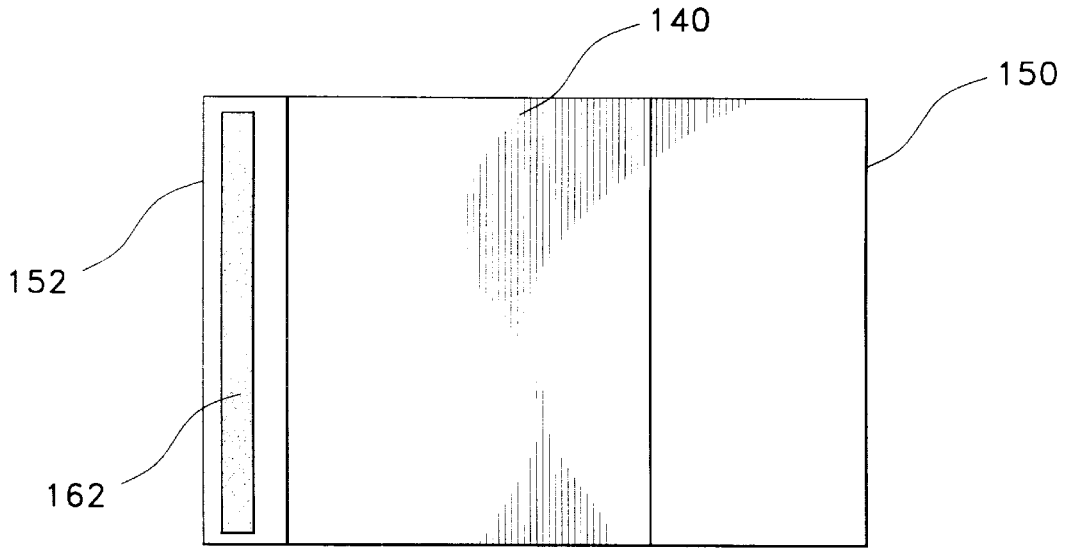
FIG. 3B is a front plan view of a folded photo postcard display stand showing the top adhesive tape's location.
Figure 4:
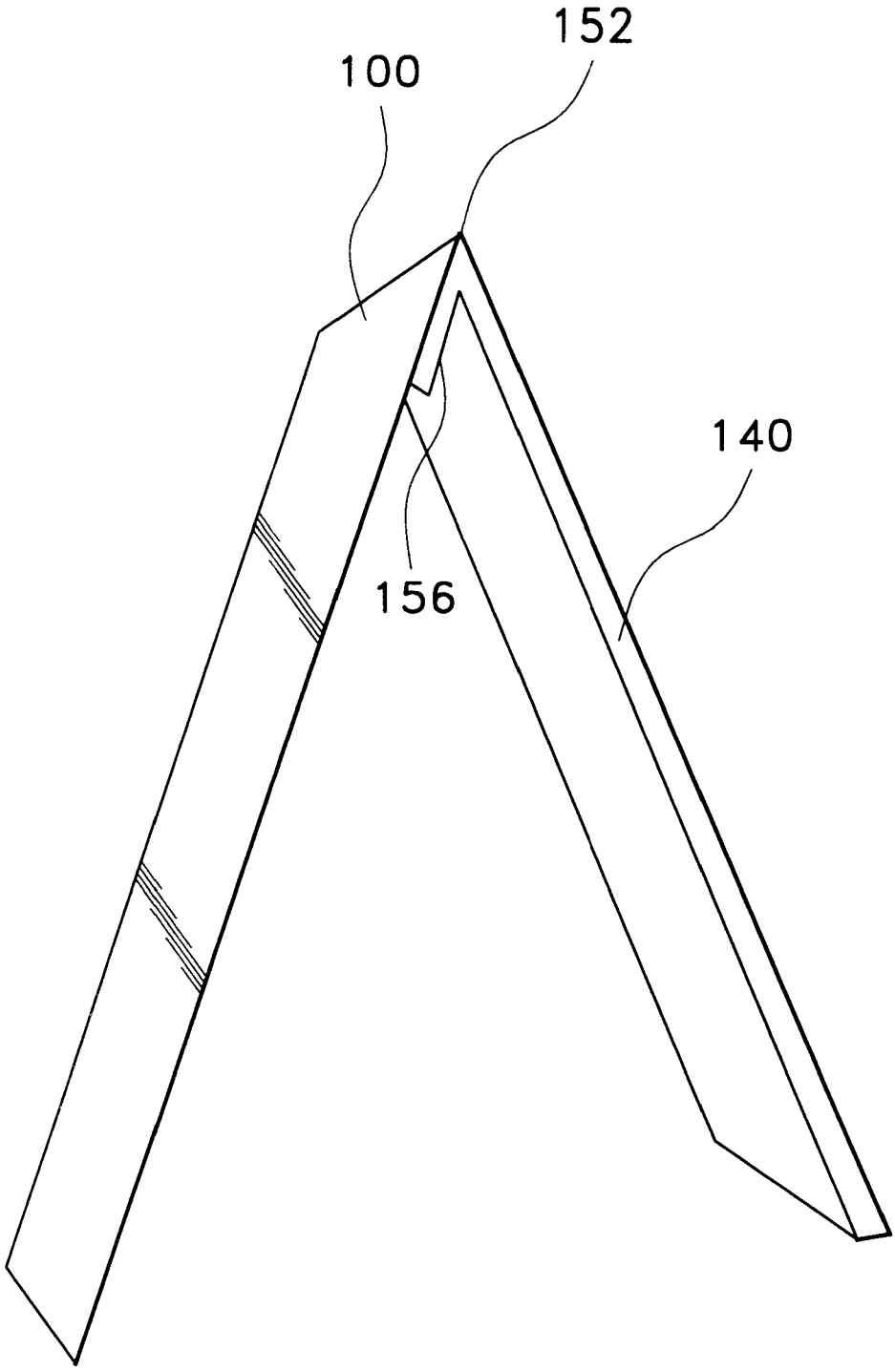
FIG. 4 is a side perspective view of a photo postcard display with a stand.

FIG. 3B is a front view of a folded photo postcard display. stand 140 showing the top adhesive tape location 162. The upper folded segment 156 with its adhesive material 162 serves as the point of attachment between the photo postcard display 100 and the stand 140 as shown in FIG. 4 which shows a side view of a photo postcard display 100 with stand 140. The stand 140 holds the display 100 in an upright position for easy viewing of the display 100 as depicted in FIG. 4.

The exact dimensions of the photo postcard display and stand can be scaled up or down to meet the needs of the picture, photograph, or artwork being displayed. In a preferred embodiment, a blank of flexible sheet material having 8 inch×8 inch dimensions is used, and a 3"×5" smaller aperture and a 4"×6" larger aperture are produced. Once a blank of flexible sheet material has been properly configured, a picture, photograph, or artwork can be easily inserted into the photo postcard display. A picture, photograph, or artwork is inserted into a partially open photo postcard display, that is, the folds of the photo postcard display are not closed. The folds of the photo postcard display are then closed and secured in place by the adhesive material framework which in turns holds a picture, photograph, or artwork securely in place. The picture, photograph, or artwork is readily removed by unfolding the photo postcard display.

The preferred embodiment of the present invention disclosed herein are intended to be illustrative only and are not intended to limit the scope of the invention. It should be understood by those skilled in the art that various modifications and adaptations of the present invention as well as alternative embodiments of the present invention may be contemplated.

It is to be understood that the present invention is not limited to the sole embodiments described above, but encompasses any and all embodiments within the scope of the following claims.

I claim:

1. A configurable visual display case or postcard capable of displaying photographs, postcards, and other flat picturesque materials, comprising a square blank sheet of flexible paper having a conformable square configuration including a symmetric arrangement of foldable triangular folds from each corner thereof to define a size adjustable square aperture;

the adjustable square aperture being increased in size by further folding each triangular fold of the flexible paper adjacent the square aperture back onto itself at least twice; and maintaining the configuration of the square aperture for either a visual display case or a mailable postcard.

2. The configurable display case according to claim 1, further including a stand for holding the display case in an upright position, attached to the top rear of the display case and having the same size as the display case.

3. The configurable display case according to claim 2, wherein the stand is made of a flexible foldable sheet material.

4. The configurable display case according to claim 3, wherein the display case and the stand are made of colored paper.

5. The configurable postcard according to claim 1, further including a mailing address, a return address and adequate postage applied to a rear side of the postcard.

* * * * *